US007321127B2

(12) United States Patent
Bavdaz et al.

(10) Patent No.: US 7,321,127 B2
(45) Date of Patent: Jan. 22, 2008

(54) OPTICAL REFLECTOR ELEMENT, ITS METHOD OF FABRICATION, AND AN OPTICAL INSTRUMENT IMPLEMENTING SUCH ELEMENTS

(75) Inventors: Marcos Bavdaz, Oegstgeest (NL); Marco Wilhelmus Beijersbergen, Sassenheim (NL)

(73) Assignee: European Space Agency, Paris Cedex (FR)

( * ) Notice: Subject to any disclaimer, the term of this patent is extended or adjusted under 35 U.S.C. 154(b) by 407 days.

(21) Appl. No.: 11/059,108

(22) Filed: Feb. 16, 2005

(65) Prior Publication Data

US 2005/0185306 A1 Aug. 25, 2005

(30) Foreign Application Priority Data

Feb. 16, 2004 (FR) ..... 04 50278

(51) Int. Cl.
*G21K 1/06* (2006.01)

(52) U.S. Cl. ..... 250/505.1; 378/145

(58) Field of Classification Search ..... None
See application file for complete search history.

(56) References Cited

U.S. PATENT DOCUMENTS 3,543,024 A 11/1970 Kantor
3,937,969 A 2/1976 Muehllehner
4,054,800 A * 10/1977 Leask ..... 378/149
4,461,018 A 7/1984 Ice et al.
5,016,267 A 5/1991 Wilkins
5,982,562 A * 11/1999 Rode ..... 359/726
6,048,070 A 4/2000 LaFiandra
6,363,136 B1 3/2002 Flisikowski et al.

FOREIGN PATENT DOCUMENTS

EP 1 085 528 A2 3/2001

OTHER PUBLICATIONS

Preliminary Search Report.
M.K. Joy, et al., "The Imaging Properties of a Silicon Wafer X-Ray Telescope," SPIE, 1994, pp. 283-286, vol. 2279, The International Society for Optical Engineering, Bellingham, WA.

(Continued)

*Primary Examiner*—Jack I. Berman
(74) *Attorney, Agent, or Firm*—Frost Brown Todd LLC

(57) ABSTRACT

The invention provides an optical reflector element (1) for a beam of X-rays ($R_X$) or of gamma-rays or of high-energy particles at grazing incidence, the element being constituted by a stack of superposed silicon plates (10-12). Each plate (10-12) has a reflecting top face (101-121) possibly coated with a metallic film, a multilayer or a dispersive grating and a bottom face carrying ribs (100-120) forming spacers between two successive plates (10-11, 11-12), and defining determined spacing between two successive reflecting faces (101-121). The invention also provides optical instruments comprising several such elements, in particular a type I Wolter telescope comprising two mirrors in tandem having respective paraboloid and hyperboloid surfaces of revolution or a conical approximation thereof or a Kirkpatrick-Beaz system.

24 Claims, 5 Drawing Sheets

OTHER PUBLICATIONS

Paul Kirkpatrick, et al., "Formation of Optical Images by X-Rays," Journal of the Optical Society of American, Sep. 1948, pp. 766-774, vol. 28, No. 9, Optical Society of America, Washington D.C.

R.C. Woodbury, et al., "Curved Silicon Substrates for Multilayer Structures," SPIE, 1986, pp. 69-75, vol. 691, The International Society of Optical Engineering, Bellingham, WA.

Larry V. Knight, "The Investigation of Multilayer X-Ray Reflectors as X-Ray Optical Elements," Final Report to the U.S. Department of Energy San Francisco operations Office, DOE/DP/10741-1, Dec. 15, 1989, pp. 1-52, Brigham Young University Department of Physics, Provo, Utah.

M.W. Beijersbergen, et al., High-Resolution Micro-Pore X-Ray Optics Produced with Micro-Channel Plate Technology, SPIE, 2001, pp. 188-192, vol. 4145. The International Society for Optical Engineering, Bellingham, WA.

* cited by examiner

OPTICAL REFLECTOR ELEMENT, ITS METHOD OF FABRICATION, AND AN OPTICAL INSTRUMENT IMPLEMENTING SUCH ELEMENTS

The invention relates to an optical reflector element, and more particularly to an optical reflector element operating at grazing incidence for radiation in the X-ray or gamma ray wavelength or for high-energy particles.

The invention also relates to a method of fabricating such elements.

The invention also relates to an optical instrument implementing such elements, and in particular a telescope.

A particular, but non-exhaustive, application of the invention lies in space missions involving the observation of particular regions of space in the above-mentioned X-ray ranges, in particular those containing radiation sources that are very hot.

Nevertheless, the invention can be applied in numerous other fields: testing materials subjected to X-rays, medical applications requiring the use of X-rays, etc.

However, in order to be more concrete, the text below relates to the preferred application of the invention, but without limiting its scope in any way thereto, i.e. it relates to optical reflector elements for X-rays at grazing incidence, and to their use for making mirrors, in particular for a telescope.

Such applications are of great importance in modem astronomy.

In applications of this kind, it is well known that X-rays present problems that are very particular.

In order to obtain an image from an X-ray beam or in order to analyze its spectrum, it is necessary to focus the beam. Unfortunately, radiation in this wavelength range (10 nanometers (nm) to 0.1 angstroms (Å)) is highly energetic and passes through most materials, and in particular the materials used for making conventional optical instruments (glass, etc.), or else it is absorbed by other materials (e.g. lead). X-rays therefore can be reflected only on striking a reflecting surface at grazing incidence, with this applying all the more with increasing energy level (shorter wavelength).

In the prior art, in particular for making telescopes, several successive configurations of optical elements have been proposed. The main proposals are the following: so-called Kirkpatrick-Baez telescopes (1948); the so-called Wolter telescope (1951) which is implemented in three different ways known as types I to III; and so-called "lobster eye" telescopes (1979) proposed by Angel.

For a more detailed description of telescopes of those types, reference can profitably be made to the article by H. Wolter published in "Annalen der Physik"; "6. Folge, Band 10", 1952, pp. 94 and 286; or the article by Kirkpatrick and A. V. Baez entitled "Journal of the Optical Society of America", 38, 1948, pp. 766 et seq.

In particular, type I Wolter telescopes are the most widely used in astronomy. In telescopes of that type, the mirrors are disposed in a coaxial configuration and share a common focus, more precisely the configuration is of the paraboloid-hyperboloid type.

Specifically, the "XMM-Newton" satellite launched on Dec. 10, 1999 has three telescopes of that type on board.

In each of the telescopes, focusing is provided by 58 concentric shells on a common alignment, so as to obtain a large collecting surface area. The shells are rotationally symmetrical and combine parabolic and hyperbolic sections. The shells are made using fine foils of gold-covered nickel.

Each telescope is 60 centimeters (cm) long and has a diameter of 70 cm. The focal length is 7.5 meters (m).

The main requirements that must be satisfied by the on-board telescopes are the following, in particular:

- a very good reflection coefficient at grazing incidence for the surfaces of the mirror elements making up the telescope;
- good surface properties for said elements: little roughness and good flatnessness;
- low overall weight;
- good angular resolution; and
- high sensitivity.

Some of these requirements would appear to be contradictory. In particular, since small grazing angles are necessary, the telescope makes use of reflecting optical elements that are of large dimensions, which, a priori, implies large weight.

The first requirement can be satisfied by resorting to suitable materials, such as gold as is the case for the optical elements implemented in the telescopes of the above-mentioned XMM-Newton satellite.

Proposals have also been made to use silicon, which present excellent optical qualities, in particular concerning reflectivity and surface properties.

Various techniques have been proposed in the prior art in an attempt to satisfy the above-mentioned requirements. By way of non-exhaustive example, mention can be made of those described in the following documents, most of which use silicon in order to obtain good surface state and good reflection:

- the article by M. K. Joy et al. entitled "The imaging properties of a silicon wafer X-ray telescope", SPIE, 1994, Vol. 2279, pp. 283-286: that document describes an optical system of the Kirkpatrick-Baez type made using silicon wafers supported by their mount to focus X-rays;
- the article by L. V. Knight entitled "The investigation of multilayer X-ray reflectors as X-ray optical elements", "DOE/DP/10741-1", pp. 1-52, Dec. 15, 1989: that document describes the use of silicon wafers having ribs etched on their rear faces and having front faces each carrying a multilayer coating for focusing X-rays;
- the article by R. C. Woodbury et al. entitled "Curved silicon substrates for multilayer structures", "Proceedings of SPIE—The International Society for Optical Engineering", Vol. 691, pp. 69-75, Jul. 2, 1986: that document also describes the use of silicon wafers having etched ribs and used as a substrate for a multilayer coating for focusing X-rays;
- the article by M. W. Beijersbergen et al. entitled "High-resolution micropore X-ray optics produced with microchannel plate", "Proceedings of SPIE", Vol. 4145, pp. 188-192, 2001: that document describes the use of glass fibers having square holes and stacked in order to focus X-rays. The structure described is not of the plate type;
- U.S. Pat. No. 6,048,070 A (Carlo F. LaFiandra) entitled "Durable large stroke deformable mirror": that patent describes plates having resilient suspensions on their rear faces and shaped by means of actuators. Those plates are used as deformable mirrors; and
- European patent application EP 1 085 528 A2 (CE.TE.V. Centro Technologie Del Vuoto et al.) entitled "Method to manufacture X-ray mirrors with thin film multilayer structures by replication technique": that patent application describes a method of reproducing mirrors from a mandrel for an X-ray reflecting structure.

Those prior art techniques summarized briefly above serve to satisfy the above-mentioned requirements in imperfect manner, only.

The invention seeks to mitigate the drawbacks of prior art devices and/or methods, some of which are mentioned above.

An object of the invention is to provide an optical reflector element, more particularly a grazing incidence optical reflector element for radiation in the X-ray wavelength range or for particles.

For this purpose, according to a first important characteristic, the optical element of the invention is made on the basis of a stack of plates having ribs on their rear faces, the plates being disposed on one another and the ribs acting as spacers to define very accurate inter-plate spacings.

Implementing plates and ribs having very accurate characteristics makes it possible to obtain a stack that likewise has characteristics that are very accurate.

The ribs may constitute integral portions of the plates or they may be made separately.

The plates, in particular the base plate, i.e. the plate at what is called the "bottom" of the stack, can be shaped in such a manner that the front reflecting faces thereof have a well-determined shape.

By way of example, the surface may be a surface of revolution, and in particular a cylinder, a cone, a parabola, an ellipse, or hyperbola, in particular for symmetrical optical applications.

In particular, it is possible to obtain the conical approximation of a "Wolter" telescope.

The above-specified stack makes it possible to impose the same shape as the base plate (bottom plate) to the successive plates.

In a preferred embodiment of the invention, the plates are made using silicon wafers, thus making it possible, as mentioned above, to obtain very good surface properties and a very good coefficient of reflectivity in grazing incidence for X-rays. In addition, silicon makes it possible to obtain a thickness that is very accurate.

The use of silicon is also advantageous in the method of fabrication because of its adhesive qualities, so as to obtain a monolithic block.

The reflecting surfaces may be covered in a layer of gold, iridium, or equivalent materials, or else they may be constituted as a multilayer or a dispersive grating.

Finally, the "stack" configuration makes it possible to obtain a structure that is rigid, if so required, in which the desired shape is easily maintained, and for a weight that is lighter than that of prior art devices of comparable dimensions.

The ribbed plates may have different stiffnesses depending on orientation, thus presenting the advantage of simplifying elastic deformation along a determined axis.

The silicon may be replaced by other materials such as aluminum, beryllium, nickel, or a combination thereof. The use of an inelastic material makes it possible to obtain not only deformations that are elastic, but also deformations that are inelastic.

Another object of the invention is to provide a method of fabricating such elements.

Another object of the invention is to provide optical instruments made using such optical reflector elements.

The invention makes it possible in particular to make telescopes having the above-mentioned type I Wolter configuration, by implementing two stacks placed in tandem, combining surfaces of revolution that are of parabolic and hyperbolic shapes.

In a more preferred variant, the optical instrument of the invention is of modular type, advantageously being constituted by sectors, themselves subdivided into subsectors or modules, referred to below as "petals".

The assembly constitutes an optical system that can be said to be "porous", thereby making it possible to reduce very considerably the weight and the overall dimensions of the optical instrument, and to obtain a "conical configuration" to a good approximation.

The dispositions of the invention serve to reduce the above-mentioned weight by one or more orders of magnitude.

The invention thus mainly provides an optical reflector element for a beam of X-rays, gamma rays, or high-energy particles at grazing incidence, the element being characterized in that it comprises at least two superposed plates forming a stack, and in that each plate has a "top" first face that is reflective for said beam and a second face which has several ribs that form spacers between two successive plates of said stack so as to define a determined spacing between two successive reflecting faces.

The invention also provides a method of fabricating such elements.

A processing apparatus according to the invention comprises an electrostatic and/or a vacuum device.

The invention also provides an optical instrument implementing such elements.

The invention is described below in greater detail with reference to the accompanying drawings, in which.

Below, and without the scope of the invention being limited in any way thereto, the description is given in the context of the preferred application of the invention, i.e. to reflecting X-rays at grazing incidence, unless specified to the contrary.

Examples of optical reflector elements and how they are made are described below with reference to FIGS. 1 to 5D.

In the figures, identical elements are given the same references and are described again only where necessary.

Figure 1:
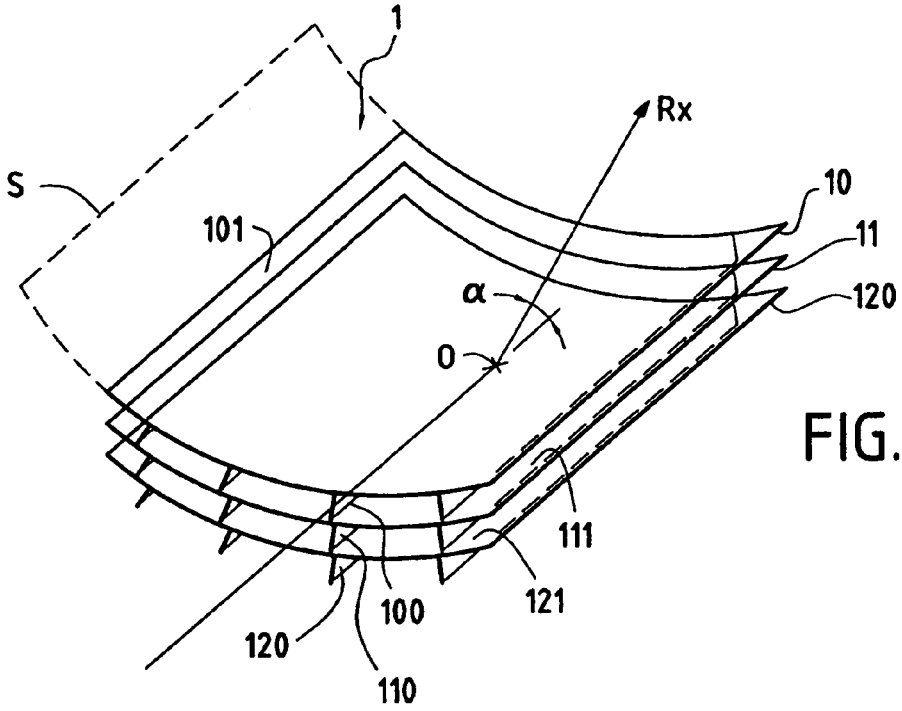
FIG. 1 is a diagram showing an embodiment of an optical element of the invention that reflects X-rays at grazing incidence.

FIG. 1 is highly diagrammatic and shows the basic structure of such an element given reference 1.

According to an essential characteristic of the invention, the optical reflector element 1 is made up of a plurality of plates, three plates in the example of FIG. 1 references 10 to 12 that are stacked on one another. These plates 10 to 12 are provided with ribs 100 to 120 on their rear faces that form spacers and that define well-defined inter-plate distances.

The ribs 100 to 120 may be formed integrally with the plates 10 to 12, or they may be made separately.

The front faces 101 to 121 of the plates 10 to 12 reflect X-rays, as symbolized in FIG. 1 by a single ray Rx striking the surface 101 of the top plate 10 at O, at a grazing incidence, i.e. at an angle of very small magnitude. In reality, the X-ray is reflected by each of the front face surfaces 101 to 121 of the plates 100 to 120.

The plates 10 to 12 can be curved so that the reflecting front faces occupy a surface S of predetermined shape, for example a surface of revolution that may be cylindrical, parabolic, elliptical, or hyperbolic, as mentioned above.

The ribbed plates 10 to 12 may present different stiffnesses depending on orientation, thus simplifying elastic deformation along a determined axis.

Figure 2A:
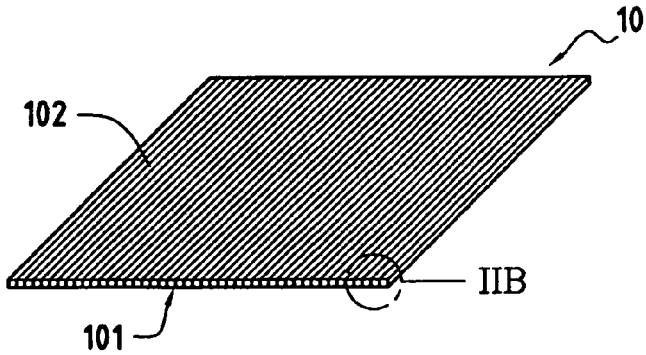
FIGS. 2A and 2B are diagrams showing a ribbed plate constituting the base of an optical reflector element of the invention.

FIG. 2A shows an embodiment of one of the plates, e.g. the plate 10, shown with its rear face turned upwards in the figure.

The base material is advantageously monocrystalline silicon, but it could equally well be aluminum, beryllium, nickel, or any material having similar relevant properties.

The use of an inelastic material makes it possible to obtain deformations that are inelastic, and not only elastic deformations.

The plate 10 is polished on both faces 101 and 102, and it is preferably coated, on its front reflecting face 101, in a thin layer 1010 of material having high reflecting power, e.g. gold. Its rear face 102 carries ribs 100, which a priori are regularly spaced apart, as shown more particularly in detail FIG. 2B.

The gold layer 1010 may be replaced by a layer of iridium or of similar materials, or it may be in the form of a multilayer or a dispersive grating.

A method of fabricating a plate 10 (to the final state) is described below.

Figure 3:
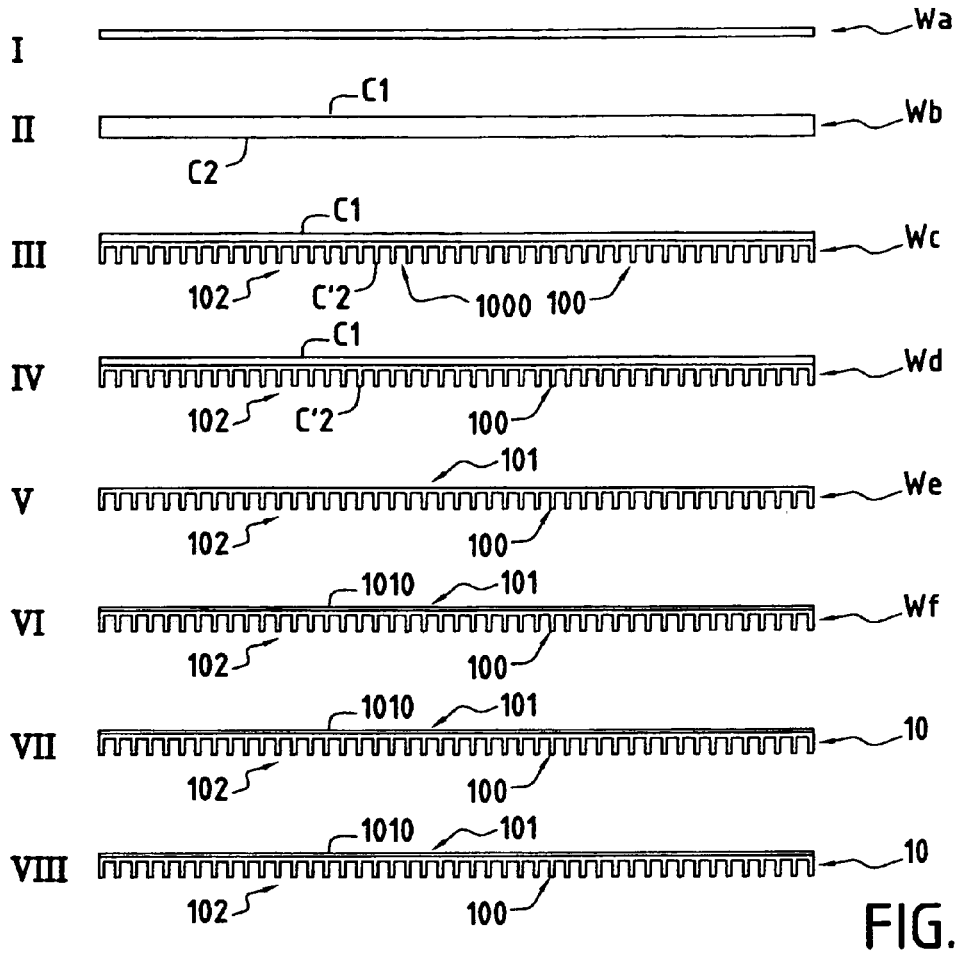
FIG. 3 shows the main steps in fabricating such a plate.

FIG. 3 shows the main steps in the fabrication method.

In step I, a "raw" silicon wafer referenced Wa is inspected with suitable metrological instruments that are well known to the person skilled in the art so as to ensure that the wafer 10*a* complies with pre-established specifications.

In step II, the two faces of the silicon wafer, now referenced Wb, are covered in respective layers of protective materials C1 and C2.

In step III, one face 102 of the silicon wafer, now referenced Wc, which face is arbitrarily called the rear face, is worked mechanically in order to dig channels 1000 therein so as to obtain ribs 100, this action taking place through the protective layer, now referenced C'2.

In step IV, both faces of the silicon wafer, now referenced Wd, are etched chemically so as to remove the layers of protective material (step V: wafer now referenced We).

In step VI, a fine layer of gold 1010 is applied to the "top" face, i.e. the reflecting face 101 of the silicon wafer, now referenced Wf.

Figure 2B:
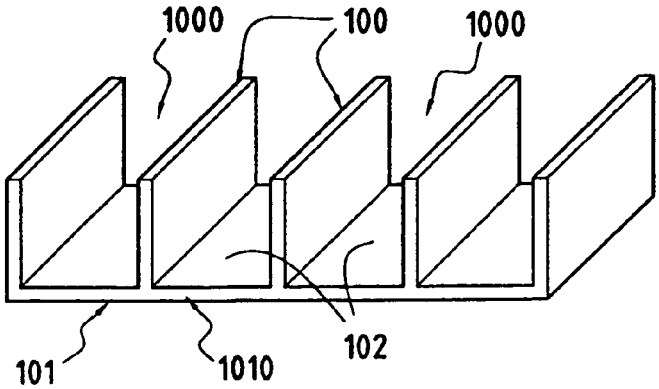

In step VII, the silicon wafer is cut to a predetermined shape, e.g. square, in order to obtain the plate 10 in the final state (FIGS. 2A and 2B).

In step VIII, conventional measuring operations are performed in order to ensure that the final product, i.e. the plate 10, complies with a pre-established specification concerning dimensions, coefficient of reflection, surface properties, etc.

After these steps I to VIII, a reflecting structure (plate 10) is obtained that can be referred to as a "basic" structure.

In itself, this structure is similar to certain prior art structures.

The various plates that are obtained are then stacked, in accordance with one of the essential characteristics of the invention.

FIGS. 4A to 4D show the main additional steps needed for making a stack type reflecting element in accordance with this aspect of the invention.

Figure 4A:
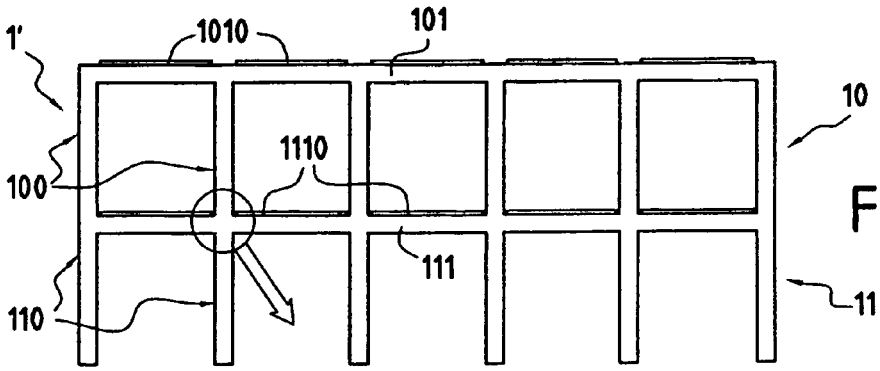
FIGS. 4A to 4D show the main steps in assembling two plates of this type in order to obtain a stack.

FIG. 4A shows a stack 1' of two plates, e.g. plates 10 and 11 (the top plates in FIG. 1). This stack structure 1' constitutes an optical reflector element in accordance with the invention that can be referred to as being "minimal". In fact, and as described below, the number of stacked plates is generally much greater, typically being of the order of a few tens. By way of concrete example, fifty plates are stacked one on another.

Figure 4B:
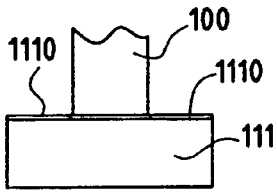

The first step, shown in FIG. 4B, consists in aligning two successive plates 10 and 11 in the example described in these figures. To do this, conventional metrological means are used.

When two successive plates 10 and 11 are properly aligned, these two plates are bonded together (FIG. 4C) via the bottoms of the ribs 100 of the top plate 10, and via the top plate 111 of the bottom plate 11.

An annealing step is then performed to stabilize the bonding:

FIG. 4D.

After these steps, a unit structure of two superposed plates 10 and 11 is obtained, i.e. a structure having two reflecting surfaces in the form of gold layers 1010 and 1110, at a spacing that is determined by the spacer-forming ribs 100.

In a preferred embodiment, and as stated above, the stacked plates 10 to 12 (FIG. 1) are shaped so as to occupy a predetermined surface S.

FIGS. 5A to 5D are diagrams showing the main steps needed for obtaining an optical reflector element of this type.

Figure 5A:
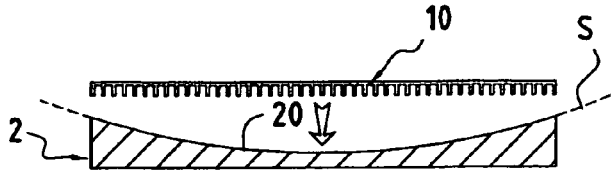
FIGS. 5A to 5D show the main steps in assembling plates in order to obtain a module constituting the optical reflector element of FIG. 1, in a preferred embodiment of the invention.

During the step shown in FIG. 5A, a plane type plate 10, as obtained after steps I to VIII of FIG. 3, is shaped using an alignment and stacking jig 2 whose top plate 20 lies in the above-specified surface S.

Figure 5B:
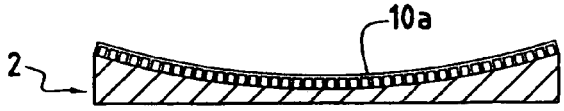

In the step shown in FIG. 5B, the plate 10, now referenced 10*a*, is pressed against the top face 20 of the jig 2 and is bonded to said face 20.

Figure 5C:
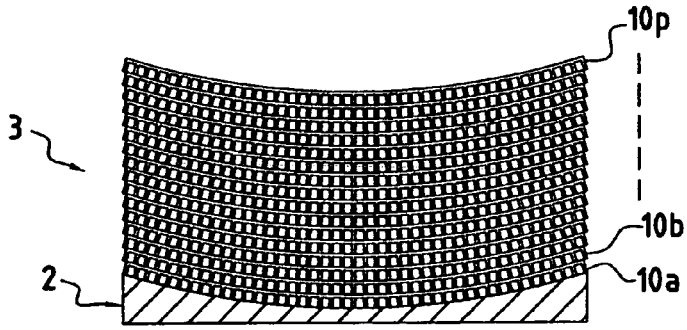

During the step shown in FIG. 5C, a plurality of plates, referenced 10*b* to 10*p* are successively stacked, aligned, and bonded one on another in order to form an optical reflector element of the stack structure in accordance with the invention and now referenced 3.

More generally, the plates are secured to one another since the use of an adhesive substance is not always needed. With certain materials, as is the case for silicon having a surface of high quality, bonding takes place naturally without adding any adhesive substance, merely by pressing together two surfaces that are to be joined.

Figure 4C:
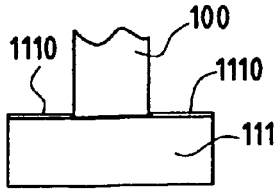
Figure 4D:
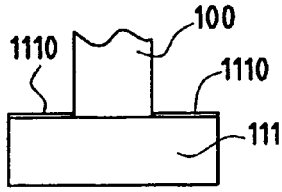

In order to obtain proper alignment and bonding, the operations described with reference to FIGS. 4B to 4C are performed for each pair of superposed plates, e.g.; 10*a* and 10*b*.

Because of its good bonding qualities, the use of silicon makes it possible to obtain a monolithic optical block.

The ribs may be obtained by methods that are mechanical, or chemical, or both, or by other methods that are well known to the person skilled in the art.

The plates may be obtained by electroforming.

In a real embodiment, the number of stacked plates 10*x* can typically reach a value x=50, as mentioned above.

Figure 5D:
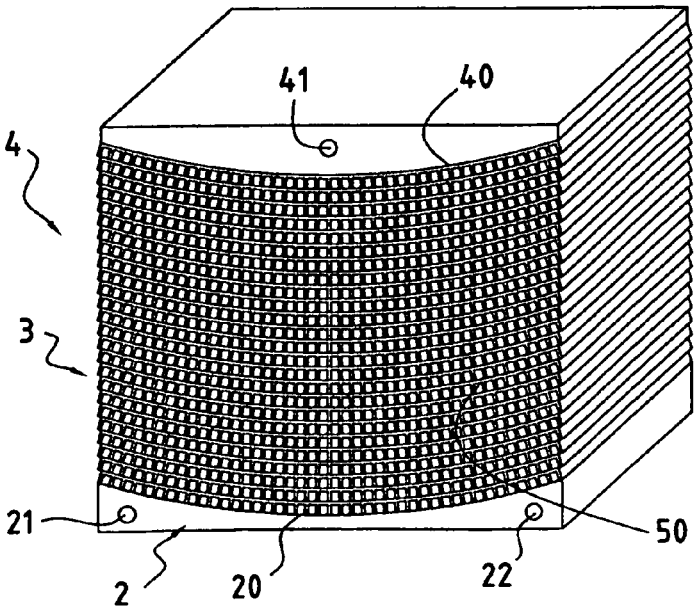

The assembly as obtained in this way can be placed between two base elements, as shown in FIG. 5D. In the example of FIG. 5D, the first base element is constituted by the jig 2. A top base element 4 has a bottom face 40 complementary in configuration to that of the top face 20 of the bottom base element 2.

Assembly elements can be provided at the bottom (21-22) and at the top (41). These elements enable a plurality of stacks of the above-described type to be fastened to one another or they enable one of these stacks, forming a module referenced 5, to be fastened to a suitable frame.

The resulting structure (module 5) is referred to as a "petal" for reasons explained below.

The assembly or module 5 thus constitutes a multiple surface optical reflector element in which each layer of gold (FIG. 4A: 1010 and 1110) is suitable for reflecting an X-ray striking it at a grazing incidence.

The module 5 of the optical reflector element can be said to be "porous". If reference is made again to FIGS. 2B and 4A, it can readily be seen that given the specific shape of the plates 10 and 11, and given the typical dimensions mentioned above, a majority fraction of the "front" wall 50 of the element 5 is not filled with material.

With reference to FIGS. 6A to 8, there follows a description of fabricating optical instruments implementing such optical reflector elements.

In these figures, elements that are identical, and identical to elements of FIGS. 1 to 5D, are given the same references and are described again only where necessary.

Figure 6A:
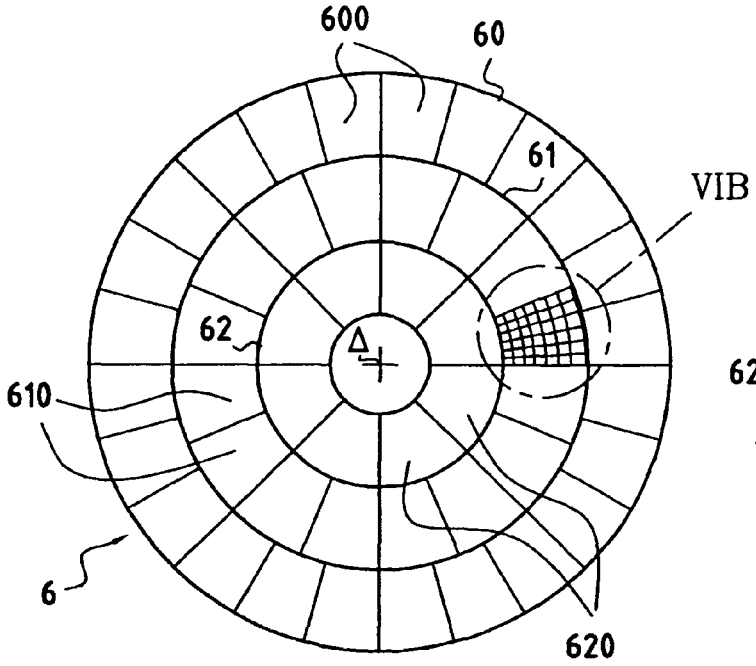
FIGS. 6A to 6C show an embodiment of a mirror implementing such modules.
Figure 6B:
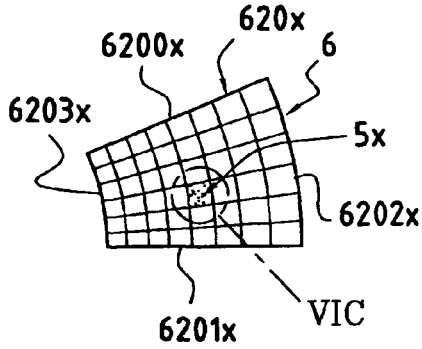
Figure 6C:
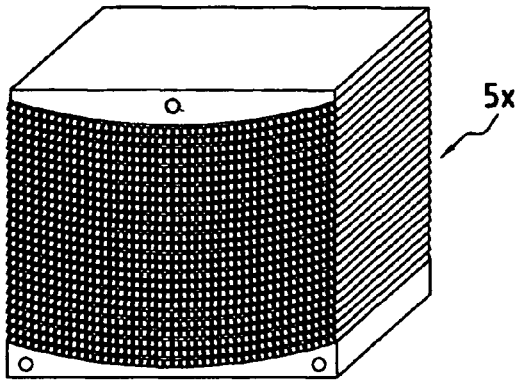

FIGS. 6A to 6C show a mirror of large dimensions obtained by assembling together a large number of modules 5 of the FIG. 5D type, referred to as "petals" as mentioned above.

FIG. 6A shows the mirror 6 proper as seen in face view. It is rotationally symmetrical about an optical axis. More precisely, in the example described, the mirror 6 is constituted by three concentric rings 60 to 62, with each ring comprising a plurality of touching sectors 600 to 620, respectively, having adjacent walls that are plane.

FIG. 6B shows one of the sectors of the middle ring 62, which sector is referenced 620*x*. The two side walls (i.e. the walls in contact with adjacent modules in the ring 620) are referenced 6200*x* and 6201*x* and are plane. The two walls referred to as the top wall 6202*x*

(i.e. the wall in contact with the ring 620) and the bottom wall 6203*x* (i.e. the wall in contact with the ring 620) occupy circular arcs.

As shown in FIG. 6C, each sector 620*x* is itself subdivided, i.e. it is made up of a plurality of touching modules, referenced 5*x*.

The mirror 6 thus has a configuration that is reminiscent of the petals of a flower, with each petal being constituted by one of the modules 5*x*.

By way of concrete example, in a practical embodiment, the height (distance between rings) of a sector 620*x* is typically about 60 cm, and the height of a "petal" is about 60 mm.

X-rays enter through the front face of the stack, impinge upon mirror 6 at grazing incidence, and are deflected by the reflecting surfaces (see FIG. 4A: 1010 and 1110) associated with the plates stacked in the "petals"5*x*.

Such mirrors can be implemented to make a telescope, for example a Wolter telescope of the above-mentioned type I.

Figure 7B:
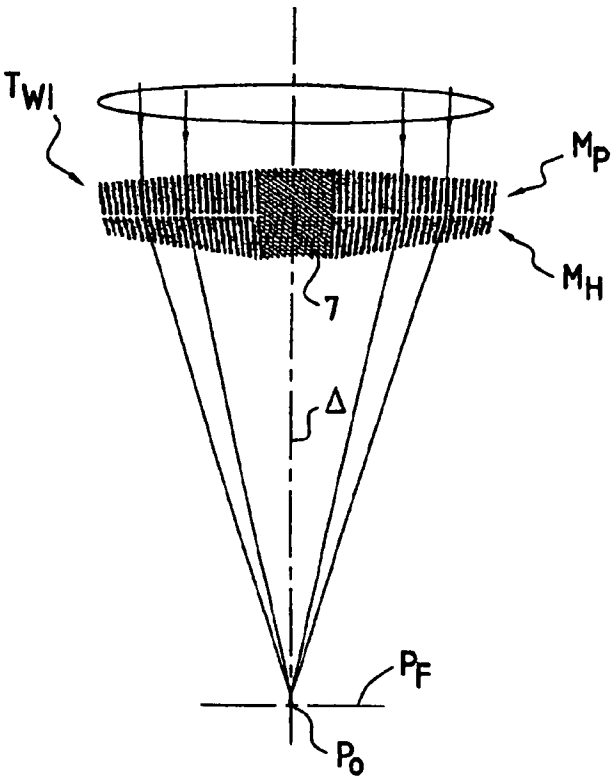
FIGS. 7A to 7C show the application of such mirrors to making a type I Wolter telescope.
Figure 7C:
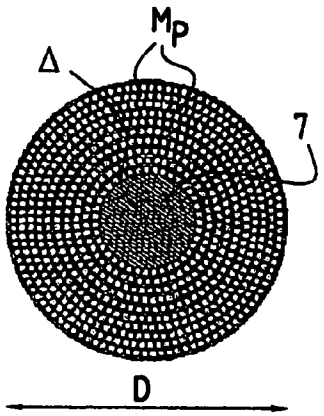
Figure 7A:
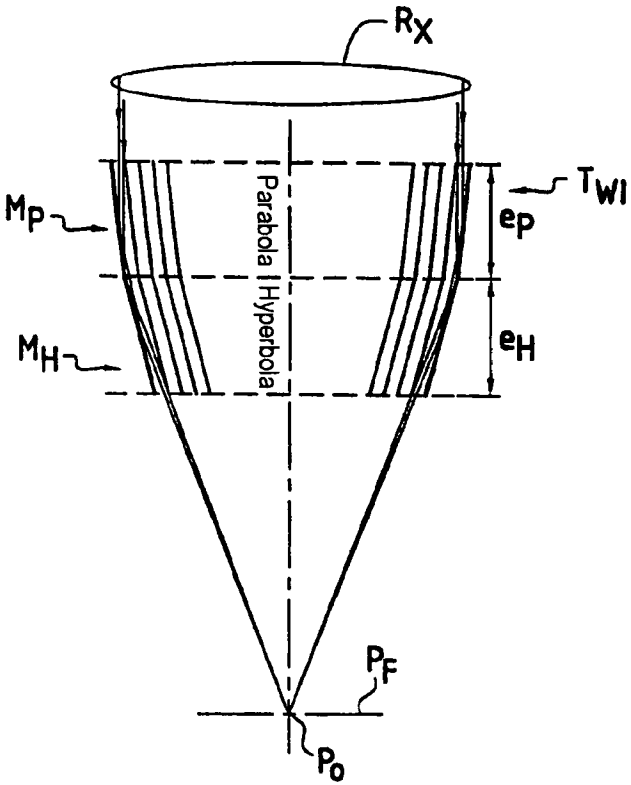

FIGS. 7A to 7C are diagrams showing the principle on which such a telescope operates and showing its basic configuration.

FIG. 7A shows the operating principle of a type I Wolter telescope referenced TWI. It comprises two mirrors in cascade, a parabolic mirror MP at the entrance to the telescope TWI, and a hyperbolic mirror MH at its exit.

A collimated beam of incident X-rays penetrating into the telescope TWI parallel to its optical axis is reflected by the two successive mirrors MP and MH and is focused on a focal plane PF at a focal point P0 lying on the optical axis.

The structure described above with reference to FIG. 7A forms part of the prior art, for example it constitutes the structure of the telescope on board the XMM-Newton satellite.

The important difference lies in the nature of the mirrors used.

In the above-mentioned XMM-Newton satellite, each mirror is built up on the basis of 58 concentric shells on a common axis.

In a device in accordance with the invention, each mirror is of a type similar to the mirror of FIG. 6A, i.e. it is based on modules 5*x* (FIG. 6C) referred to as "petals", with the assembly forming a structure that is referred to as being "porous".

FIG. 7B is an axial section through the configuration of a telescope TWI comprising two mirrors MP and MH disposed in tandem in accordance with the invention. FIG. 7C shows the same telescope as seen from above (looking at its entry face).

In order to obtain a common focus, it is necessary for the angle of reflection relative to the optical axis of the telescope TWI to vary as a function of radius R (FIG. 7A).

Figure 8:
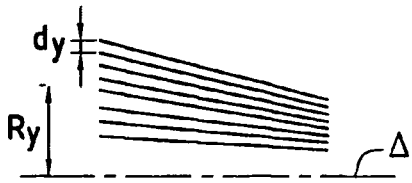
FIG. 8 is a diagram showing a technical disposition relating to the mirrors constituting the telescope.

To do this, and as shown diagrammatically in FIG. 8, the distance dy between the reflecting surfaces (see FIG. 4A: 1010 and 1110) associated with the plates constituting the "petal" modules 5*x* (FIG. 6C) varies in compliance with a predetermined relationship as a function of the radius Ry, i.e. of the distance between any point and a reflecting surface of the optical axis.

The thickness of the "petals" therefore varies in a direction parallel to the optical axis. It is smaller towards the focus.

The mirrors MP and MH may be fastened to a suitable frame, in a manner that is itself conventional.

For a space mission, the optical and geometrical characteristics of the mirrors MP and MH, and in particular of the "petals" 5*x* (FIG. 6C) making them up (alignment, etc.) can be adjusted on the ground using suitable metrological instruments (optical benches, etc.). If the "petals" 5*x* are mounted with actuators, they can subsequently be aligned actively in orbit under remote control from the ground or by any other means: on-board electronics, etc.

From the above, it can readily be understood that the invention achieves the objects it set out to achieve.

In particular, and without repeating all of its advantages, it makes it possible to reduce considerably the overall weight of the optical system, while satisfying as well as possible the requirements set out in the introduction of the present description, in particular for the wavelengths concerned (X-rays, gamma rays or high-energy particles). In particular, and as mentioned in that introduction, an optical system implementing reflector elements in accordance with the invention is characterized by a weight that is significantly lighter than that of comparable systems in the prior art.

This makes it possible to make telescopes of large aperture, which are therefore highly sensitive, but without any corresponding excessive increase in weight, which is particularly important for an optical system that is to be put into orbit and carried on board a satellite.

Nevertheless, it should be clear that the invention is not restricted to the particular embodiments described explicitly, in particular with reference to FIGS. 1 to 8.

In particular, the instruments made are not restricted to Wolter telescopes of type I, but also cover type II, or indeed any other type of instrument having at least one optical element in accordance with the invention for reflecting at grazing incidence.

As mentioned above, the invention is not limited to applications relating to space missions (observing X-ray sources or similar missions). The invention finds applications in numerous other fields: testing materials by means of X-rays, medical applications requiring the use of X-rays, etc.

The invention also applies to other wavelengths: gamma rays, and to high-energy particles.

Finally, the numerical values given and the examples of suitable materials are provided merely by way of concrete example and do not constitute any kind of limitation on the scope of the invention. They are technological selections within the competence of the person skilled in the art.

We claimed:

1. An optical reflector element for a beam of X-rays, gamma rays, or high-energy particles at grazing incidence, the element comprising at least two superposed plates for forming a stack type structure, each of said at least two plates has a "top" first face that is reflective for said beam and a second face associated with a plurality of ribs forming spacers between two successive plates of said stack so as to define a determined spacing between two successive reflecting faces.

2. The optical reflector element of claim 1, wherein said stack type structure comprises a plurality of superposed plates separated by spacer-forming ribs.

3. The optical reflector element of claim 2, wherein said ribs are integral portions of said plates.

4. The optical reflector element of claim 2, wherein said ribs are separate from said plates.

5. The optical reflector element of claim 4, wherein said plates are made from wafers of at least one material selected from the group consisting of: monocrystalline silicon; aluminum; beryllium; and nickel.

6. The optical reflector element of claim 5, wherein said plates are made from wafers constituted from at least one inelastic material selected from the group consisting of: monocrystalline silicon; aluminum; beryllium; and nickel; so as to present inelastic deformation properties.

7. The optical reflector element of claim 6, wherein said reflecting top faces are covered in a layer of material having high reflectivity.

8. The optical reflector element of claim 7, wherein said material having high reflecting power is a metallic coating.

9. The optical reflector element of claim 8, wherein said layer is a multilayer or a dispersive grating.

10. The optical reflector element of claim 9, wherein said plates are shaped in such a manner that said reflecting first faces lie in determined surfaces of revolution about an axis forming an optical axis for said optical reflector element.

11. The optical reflector element of claim 10, wherein said surfaces of revolution are cylinders, cone, parabolas, ellipses, or hyperbolas.

12. The optical reflector element of claim 10, wherein said surfaces of revolution are obtained so as to obtain a conical approximation to the "Wolter" telescope or a Kirkpatrick-Beaz system.

13. A method of fabricating an optical reflector element the method being comprising at least the following steps:

making said plates from wafers of at least a first predetennined material;

making ribs for forming spacers between said plates; and cutting said wafers into predetermined configurations in order to obtain said plates.

14. The fabrication method of claim 13, further comprising the step of covering said top faces of said wafers in at least one layer of a second determined material.

15. The fabrication method claim 14, further comprising the following steps:

covering each of said first and second faces of said plates in a respective layer of protective material;

attacking said second face through said layer of protective material by mechanical working, by chemical attack, or by a combination thereof, in order to obtain said ribs; and chemically attacking said first and second faces of said plates to remove said layers of protective material.

16. The method of claim 14, further comprising the steps of:

aligning at least two plates separated by said ribs; and stacking and bonding said at least two plates together.

17. The method of claim 16, further comprising the step of shaping the stacked plates in such a manner that said first reflecting faces occupy respective predetermined surfaces.

18. The method of claim 17, wherein said first material is monocrystalline silicon, aluminum, beryllium, nickel, or a combination of said materials.

19. The method of claim 17, wherein said layer of second material covering said top faces of said wafers is made of gold or of iridium.

20. The method of claim 19, wherein said layer of second material is a multilayer.

21. An optical instrument, comprising at least one mirror, said mirror further comprising a plurality of optical reflector elements of claim 1, said optical reflector elements being arranged about an axis of said optical instrument referred to as its optical axis, so as to focus an incident beam of said X-rays or of gamma-rays or of said high-energy particles onto a "focal" plane, said beam being deflected by said reflecting first faces of the plates of said plurality of optical reflector elements.

22. The optical instrument of claim 21, wherein the optical instrument is endowed with rotational symmetry about said optical axis and further comprising a first plurality of concentric rings wherein each of said rings is subdivided into a second plurality of touching sectors, and in that each of said sectors comprises a third plurality of optical reflector elements.

23. The optical instrument of claim 22, comprising two mirrors placed in tandem, in that said reflecting first faces of the plates of said optical reflector elements of the first of said mirrors are shaped so as to obtain parabolic surfaces of revolution, in that said reflecting first faces of the plates of said optical reflector elements of the second of said mirrors are shaped so as to obtain hyperbolic surfaces of revolution, and in that said first mirror is disposed on an entry face of said optical instrument so as to implement a "Wolter" telescope of types known as I or II, for said X-ray beam or for said gamma-ray beam or for high-energy particles entering the front of said telescope at grazing incidence, or a conical approximation thereof or a Kirkpatrick-Beaz system.

24. The optical instrument of claim 23, wherein said spacings between two consecutive reflecting first faces of the plates of said optical reflector elements vary in compliance with a predetermined relationship as a function of the distance between them and said optical axis as to obtain a common focus.

* * * * *